United States Patent [19]

Witek, Jr. et al.

[11] 4,003,617

[45] Jan. 18, 1977

[54] SOLDERLESS ELECTRICAL CONNECTOR FOR PRINTED CIRCUIT

[75] Inventors: Roman J. Witek, Jr., Gilbraltar; Stephen J. Grebik, Roseville, both of Mich.

[73] Assignee: Essex International, Inc., Fort Wayne, Ind.

[22] Filed: Mar. 17, 1976

[21] Appl. No.: 667,794

[52] U.S. Cl. ..... 339/17 C; 339/217 S

[51] Int. Cl.[2] ..... H01R 9/12

[58] Field of Search ..... 339/17 C, 217 S

[56] References Cited

UNITED STATES PATENTS

| | | | |
|---|---|---|---|
| 3,142,527 | 7/1964 | Eggman | 339/217 S |
| 3,340,497 | 9/1967 | Balint | 339/217 R |
| 3,444,502 | 5/1969 | Matthews | 339/17 C |
| 3,585,576 | 6/1971 | Meyers | 339/217 S |
| 3,853,389 | 12/1974 | Occhipinti | 339/217 S |

*Primary Examiner*—W. Tupman
*Assistant Examiner*—Mark S. Bicks
*Attorney, Agent, or Firm*—Robert D. Sommer; Lawrence E. Freiburger

[57] ABSTRACT

A receptacle electrical terminal is mounted on a printed circuit board making a solderless electrical connection to one of the conductive strips thereon. The receptacle terminal includes a pair of mounting lugs which serve to lock it on the printed circuit board and a pressure contact surface which completes the electrical circuit from the conductor on the printed circuit board to the receptacle terminal when it is locked onto the circuit board.

3 Claims, 5 Drawing Figures

SOLDERLESS ELECTRICAL CONNECTOR FOR PRINTED CIRCUIT

BACKGROUND OF THE INVENTION

Receptacle terminals for mounting on printed circuit boards are well known. These prior art receptacle terminals, however, are soldered on the printed circuit board in much the same manner as other components mounted on the printed circuit board. Typical such devices are shown in U.S. Pat. Nos. Re 26,837; 3,363,224; 3,369,212; 3,711,819; and 3,907,392. By referring to these patents, it will be seen that the receptacle connectors disclosed therein are attached to a circuit board by clinching and soldering of the mounting tabs.

In order to overcome the time consuming clinching and soldering operations, the device disclosed in U.S. Pat. No. 3,613,043 was developed. This patent shows a connector for printed circuit boards which provides a resilient pressure contact between the connector and a conductor strip. The connector of this patent has four tangs for initially locking the connector on the circuit board but relies upon clinched tongues for permanent attachment of the connector to the board.

SUMMARY OF THE INVENTION

In accordance with the present invention, a receptacle terminal is provided with means thereon for attaching the terminal to a printed circuit board. receptacle terminal of the present invention further has means thereon for making an electrical contact to a conductive strip on the circuit board. In accordance with the invention, the attaching means preferably comprises a pair of lugs on the receptacle which are adapted to be inserted into corresponding apertures in the printed circuit board. Also, in accordance with the present invention locking means is provided on each lug in the form of a resilient tang which is adapted to prevent withdrawal of the receptacle once the lugs have been inserted into the aperture in the circuit board. The invention also provides pressure contact means on the side of the receptacle adjacent the printed circuit to make contact to the conductive strip when the receptacle is locked on the circuit board.

It is an object of the present invention to provide a simple, yet reliable, electrical connection between a printed circuit board and an external electric circuit.

A further object of the present invention is to provide a simple, solderless, electric connection between a receptacle terminal and a printed circuit board.

These objects and others will become apparent to those skilled in the art as the description of the invention proceeds.

DESCRIPTION OF THE DRAWINGS

In the course of the detailed description of the preferred embodiment of the invention, reference will be made to the drawings in which.

DESCRIPTION OF THE PREFERRED EMBODIMENT OF THE INVENTION

Figure 1:
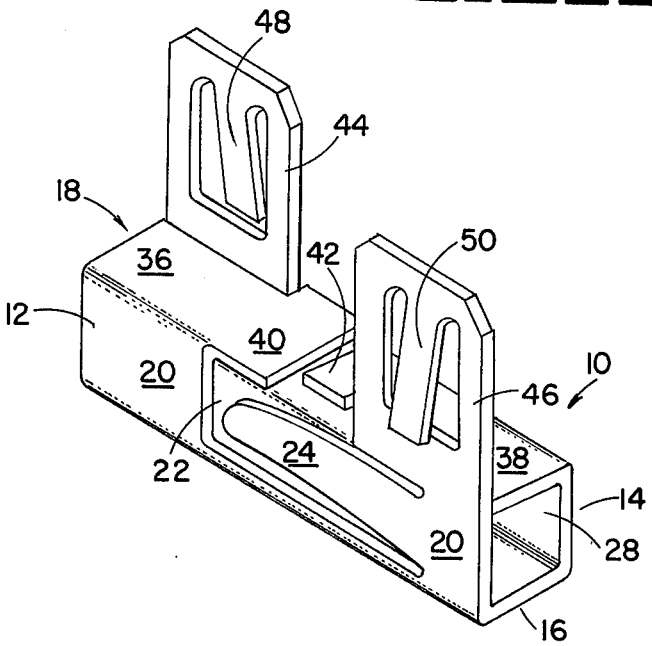
FIG. 1 is a perspective view of a receptacle terminal in accordance with the present invention.

Referring firstly to FIGS. 1–4, a receptacle terminal 10 of the present invention is a four sided box-shaped body member having first, second, third and fourth sides, indicated by reference numerals 12, 14, 16 and 18, respectively. Side 12 is defined by first wall portions 20 located at opposite ends of the body member and separated by a cutout portion 22. A contact finger 24 extends from one of the wall portions 20 towards the other and is bent inwardly near its end to form a curved convex surface 26 facing into the inside of the body member. Side 14 is identical to side 12 and is defined by second wall portions 28 located at opposite ends of the body member. Second wall portions 28 are separated by a cutout 30 and a contact finger 32 extends from one of the wall portions 28 toward the other. Contact finger 32 is bent inwardly near its end to form a curved convex surface 34 facing surface 26 on finger 24. Surfaces 26 and 34 thus form resilient and contact surfaces which serve to provide inward pressure against a pin terminal inserted into the body member so as to electrically connect the pin terminal and the receptacle.

Side 16 of the body member is substantially perpendicular to sides 12 and 14 and serves to complete the box-shaped receptacle. Side 18 is substantially parallel to side 16 and is defined by third and fourth wall portions 36 and 38 located at opposite ends of the body member. Wall portion 36 marginally joins the wall portion 20 adjacent the end of finger 24. Wall portion 36 marginally joins one of the walls 28 in a similar manner.

Both wall portions 36 and 38 terminate in a free edge that is adjacent a mounting lug extending from wall portion 28 and 20, respectively. The wall portions 36 and 38 each have a lateral extension 40 and 42 extending toward the other extension. The free side of lateral extensions 40 and 42 are inclined outwardly slightly so as to form a resilient pressure contact which abuts against a conductive strip on a printed circuit board when the receptacle is locked onto the circuit board.

Mounting lugs 44 and 46 extend from wall portions 28 and 20, respectively. Each of the lugs 44 and 46 have a locking tang member 48 and 50, respectively, a struck therefrom. The tangs 48 and 50 are normally bent outwardly from the plane defined by its lug and serve to lock the receptacle terminal on a printed circuit board as will hereinafter be described.

Figure 2:
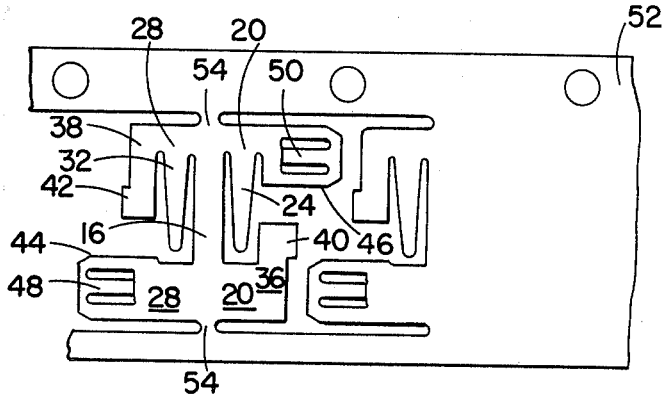
FIG. 2 is an elevational view of the blank from which the terminal of FIG. 1 is made.

Shown in FIG. 2 is the receptacle 10 in its flat form prior to bending. The same reference numerals have been applied to FIG. 2 as FIGS. 1–5 in order to clearly show the preferred method of making the receptacle. Preferably, a plurality of the receptacles are stamped from a long strip of sheet metal, indicated by reference numeral 52 as is well known in the art. After a stamping operation, the flat blanks from which the receptacle is formed remain attached to the strip of sheet metal by frangible tabs 54.

Figure 3:
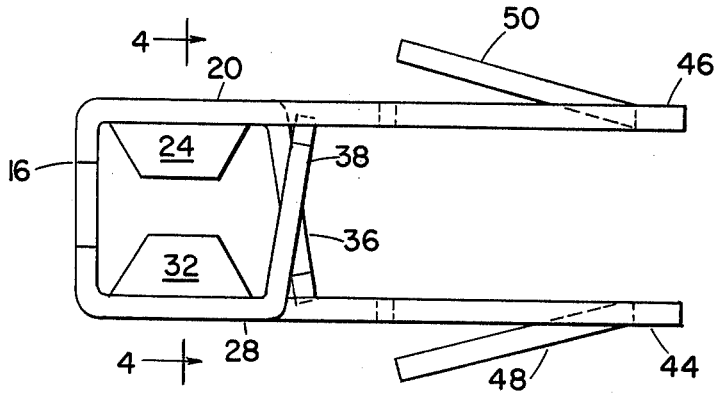
FIG. 3 is an end elevational view of the terminal of FIG. 1.
Figure 4:
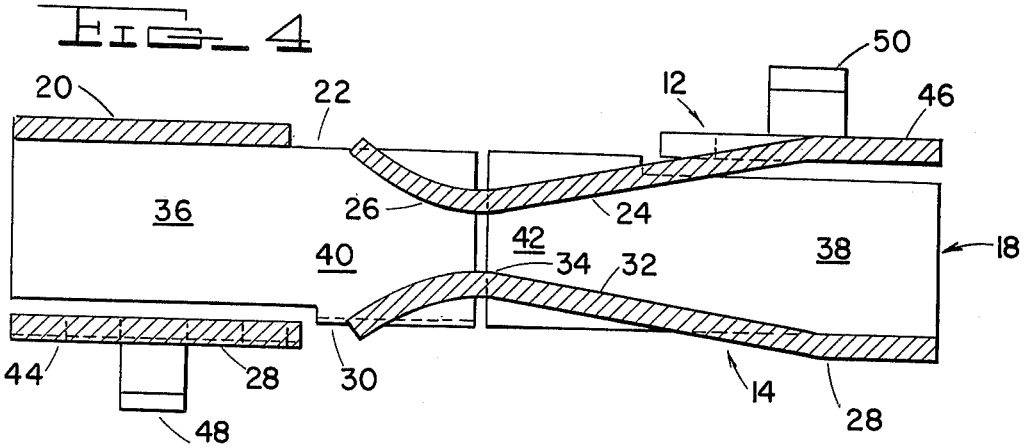
FIG. 4 is a cross sectional view taken along lines 4—4 of FIG. 3.

After stamping the outline of the blank, tangs 48 and 50 are preferably bent outwardly and sides 12 and 14 are bent at their junction with side 16 so that they are parallel. Finally, wall portions 36 and 38 are bent over to complete the box-shape of the body member but remain so that they are slightly inclined outwardly as shown in FIG. 3.

Figure 5:
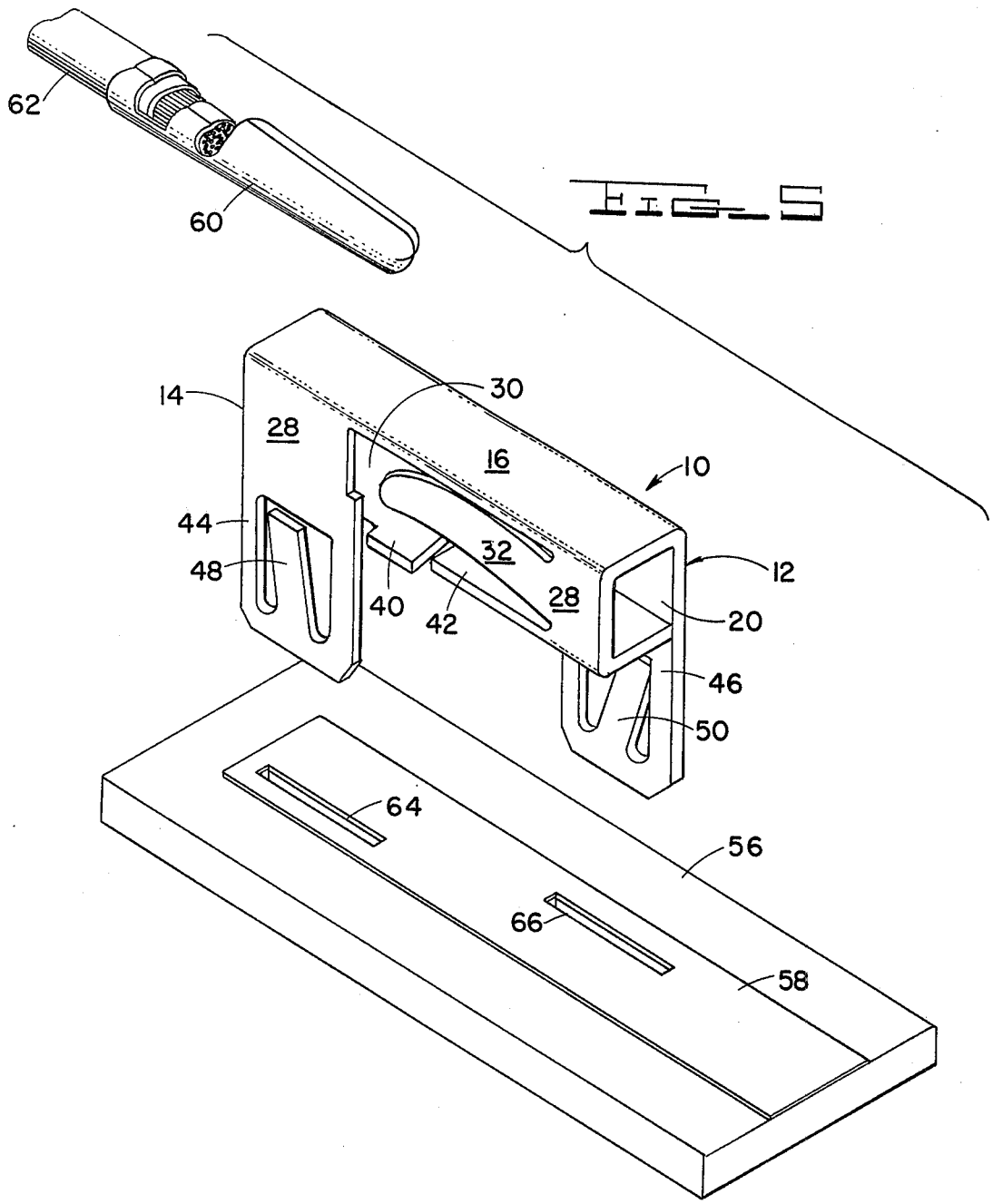
FIG. 5 is an exploded perspective view of a connector assembly utilizing the receptacle terminal of FIG. 1.

Referring to FIG. 5, the receptacle terminal 10 of the invention is adapted to be mounted on a printed circuit board 56 having a conductive strip 58 thereon and to receive a standard round pin terminal 60 which conventionally crimped onto an insulated electrical conductor 62. The pin terminal 60 may be inserted into the receptacle terminal 10 from either end. Mounting lugs 44 and 46 are received in corresponding slots 64 and 66 which extend through the conductive strip 58 and board 56. It will be appreciated that tangs 48 and 50 will deflect inwardly when inserted into slots 64 and 66. As the receptacle 10 is mounted on the printed circuit board inclined lateral extensions 40 and 42 will contact conductive strip 58. With further insertion into slots 64 and 66, tangs 48 and 50 will snap to their normal position, thus locking the receptacle on the circuit board. Of course, the relative dimensions of the receptacle are chosen so that inclined lateral extensions 40 and 42 provide a pressure contact against conductive strip 58 when the receptacle is locked on the circuit board.

It will be appreciated from this description of the invention that the receptacle terminal of the invention is easily mounted on a printed circuit board and provides a reliable elctrical connection between a pin terminal and a conductive strip on a printed circuit board. Further, the receptacle terminal of the invention can be easily removed since no solder or clinched tabs are employed.

What is claimed is:

1. A sheet metal pin receptacle of one-piece stamped and formed construction for mounting on a printed circuit board, said receptacle comprising:

a body member for receiving a pin terminal provided with substantially parallel depending mounting lugs adapted for insertion in openings in a printed circuit board;

said body member including pressure contact means for making electrical contact to said pin terminal;

the portion of said body between said parallel depending mounting lugs comprising first and second wall portions at opposite ends of the body member;

each of said first and second wall portions including a resilient lateral extension extending toward each other, said lateral extensions being inclined outwardly in opposite transverse directions so as to provide oppositely disposed, outwardly facing longitudinal edges for engagement with a conductor on a printed circuit board;

said mounting lugs including a tang lanced therefrom for securing said body member to a printed circuit board.

2. In combination, a rectangular sheet metal pin receptacle of one-piece stamped and formed construction, a printed circuit board having a rigid substrate with a plurality of conductive strips on one surface thereof, means for electrically connecting said receptacle to one of said strips comprising:

a pair of depending mounting lugs integral with and extending from opposite sides of said receptacle;

apertures in said printed circuit board for receiving said mounting lugs;

resilient locking means on said lugs for latching said receptacle on said printed circuit board;

the portion of said receptacle between said depending mounting lugs comprising first and second wall portions at opposite ends of the receptacle; and each of said first and second wall portions including a resilient lateral extension toward each other, said lateral extensions being inclined outwardly in opposite transverse directions so as to provide oppositely disposed, outwardly facing longitudinal edges for engagement with a conductor on a printed circuit board.

3. A sheet metal pin receptacle of one-piece stamped and formed construction for mounting on a printed circuit board, said receptacle comprising:

a four-sided body member of generally rectangular configuration open at opposite ends for reception of a pin terminal and provided with a pair of depending mounting lugs adapted for insertion in openings in a printed circuit board;

a first side of said body member being defined by first wall portions at the opposite ends of the body member and a first contact finger extending from one of said first wall portions toward the other of said first wall portions;

a second side of said body member being in spaced parallel relation to said first side and being defined by second wall portions at the opposite ends of the body member and a second contact finger extending from one of said second wall portions toward the other of said second wall portions;

an end portion of each of said contact fingers being bent inwardly of the respective side and having a curved convex surface facing the corresponding surface on the opposing contact finger;

a third side of said body member marginally joining said first and second sides and being substantially normal to each;

a fourth side of said body member being opposite to said third side and being defined by third and fourth wall portions at the opposite ends of the body member, said third wall portion marginally joining one of said first wall portions and terminating in a free edge that is adjacent the opposite one of said second wall portions, said fourth wall portion marginally joining the other of said second wall portions and terminating in a free edge that is adjacent the opposite other of said first wall portions, each of said third and fourth wall portions including a resilient lateral extension extending toward each other, said lateral extensions being inclined outwardly in opposite transverse directions so as to provide oppositely disposed, outwardly facing longitudinal edges for engagement with a conductor on a printed circuit board;

one of said depending lugs comprising a lateral extension of said other said first wall portions which projects from said body member generally in the same plane as said first side, the other of said depending lugs comprising a lateral extension of said one of said second wall portions which projects from said body member generally in the same plane as said second side, a resilient tang being lanced out from each of said depending lugs for securing said body member to a printed circuit board.

* * * * *